US009989055B2

(12) United States Patent
Hikichi

(10) Patent No.: US 9,989,055 B2
(45) Date of Patent: Jun. 5, 2018

(54) LIQUID PUMP AND RANKINE CYCLE SYSTEM

(71) Applicant: Panasonic Corporation, Osaka (JP)

(72) Inventor: Takumi Hikichi, Osaka (JP)

(73) Assignee: PANASONIC CORPORATION, Osaka (JP)

( * ) Notice: Subject to any disclaimer, the term of this patent is extended or adjusted under 35 U.S.C. 154(b) by 88 days.

(21) Appl. No.: 15/150,327

(22) Filed: May 9, 2016

(65) Prior Publication Data

US 2016/0363119 A1 Dec. 15, 2016

(30) Foreign Application Priority Data

Jun. 9, 2015 (JP) ..... 2015-116926

(51) Int. Cl.

| | |
|---|---|
| ***F04C 2/10*** | (2006.01) |
| ***F01K 13/02*** | (2006.01) |
| ***F04C 23/00*** | (2006.01) |
| ***F04C 15/00*** | (2006.01) |

(52) U.S. Cl.

CPC ..... *F04C 2/10* (2013.01); *F01K 13/02* (2013.01); *F04C 15/008* (2013.01); *F04C 15/0042* (2013.01); *F04C 23/008* (2013.01)

(58) Field of Classification Search

CPC ..... F04C 2/10; F04C 15/0042; F04C 15/008; F04C 23/008; F01K 13/02

USPC ..... 418/61.3

See application file for complete search history.

(56) References Cited

U.S. PATENT DOCUMENTS

| | | | | |
|---|---|---|---|---|
| 3,038,413 | A * | 6/1962 | Emeny | F04C 2/101 418/169 |
| 6,174,151 | B1 * | 1/2001 | Yarr | F01C 1/103 137/469 |
| 6,481,991 | B2 * | 11/2002 | Takagi | F04C 11/001 184/6.23 |
| 2008/0038135 | A1 * | 2/2008 | Daigre | F04C 2/104 418/61.3 |
| 2014/0271303 | A1 | 9/2014 | Sekiya et al. | |

FOREIGN PATENT DOCUMENTS

| | | |
|---|---|---|
| DE | 2134766 | 2/1973 |
| JP | 3-179187 | 8/1991 |
| WO | 2006/033500 | 3/2006 |

OTHER PUBLICATIONS

The Extended European Search Report dated Oct. 11, 2016 for the related European Patent Application No. 16167866.9.

* cited by examiner

*Primary Examiner* — Hoang Nguyen
(74) *Attorney, Agent, or Firm* — McDermott Will & Emery LLP

(57) ABSTRACT

A liquid pump in the present disclosure includes a pressure container, a shaft, a first bearing, a second bearing, a pump mechanism, and a thrust bearing. The internal space of the pressure container is partitioned into a high pressure side space and a low pressure side space. The shaft has a thrust supported face, one of both ends of the shaft is disposed in the high pressure side space, and the other of both ends of the shaft is disposed in the low pressure side space. The pump mechanism is disposed between the first bearing and the second bearing, and pumps liquid by rotation of the shaft. The thrust bearing is disposed to face the thrust supported face between the first bearing and the second bearing.

4 Claims, 5 Drawing Sheets

LIQUID PUMP AND RANKINE CYCLE SYSTEM

BACKGROUND

1. Technical Field

The present disclosure relates to a liquid pump and a rankine cycle system.

2. Description of the Related Art

These days, energy systems have attracted attention that utilize natural energy such as sunlight or several types of exhaust heat. One of such energy systems is a system having a rankine cycle. In general, a system having a rankine cycle operates expander by high temperature, high pressure working fluid, and generates electricity using the power taken out from the working fluid by the expander. The high temperature, high pressure working fluid is generated by a pump and a heat source (heat source such as solar heat, geothermal heat, exhaust heat of an automobile). For this reason, a liquid pump is used in a system having a rankine cycle.

As illustrated in FIG. 5, Japanese Unexamined Patent Application Publication No. 3-179187 describes a cooling medium pump 300 that is not a liquid pump used in a system having a rankine cycle but is used in a room air conditioner or the like and that transports a liquid cooling medium. The cooling medium pump 300 includes an airtight container 310, a brushless direct current electric motor 311, and a pump mechanism unit 312. The brushless direct current electric motor 311 is constituted by a stator 311*a* and a rotor 311*b*. The stator 311*a* is mounted on the outer side of the airtight container 310, and the rotor 311*b* is disposed on the inner side of the airtight container 310. A magnet 305 is stuck to the outermost circumferential portion of the rotor 311*b*. A drive shaft 313 is press-fitted into the central portion of the rotor 311*b*. The drive shaft 313 transmits rotational force which is generated in the brushless direct current electric motor 311. The pump mechanism unit 312 includes an inner rotor 325 and an outer rotor 324. The outer rotor 324 is engaged with the inner rotor 325 to form a pump chamber. The inner rotor 325 and the outer rotor 324 are housed in a cylinder 315, and are interposed between a front plate 316 and a rear plate 314. A first bearing 327, which supports the drive shaft 313, is disposed at the central portion of the front plate 316. A suction port 322 is formed in the front plate 316. A discharge port 323 is formed in the rear plate 314. The inside of the airtight container 310 is partitioned into a suction pressure space and a discharge pressure space by the rear plate 314.

When a pumping action occurs in the pump mechanism unit 312, liquid cooling medium is sucked through the suction pipe 321 and flows into the airtight container 310. Part of the liquid cooling medium flowing into the airtight container 310 flows into the pump chamber through the suction port 322. The liquid cooling medium, after being increased in pressure in the pump chamber, passes through the discharge port 323, a hole 317, and a discharge pipe 320, then is discharged to the outside of the airtight container 310.

SUMMARY

The cooling medium pump 300 described in Japanese Unexamined Patent Application Publication No. 3-179187 has a room for improvement in reliability. Thus, the present disclosure provides a highly reliable liquid pump.

The present disclosure provides a liquid pump including:

a pressure container, an internal space of the pressure container being partitioned into a high pressure side space and a low pressure side space;

a shaft that is disposed in the pressure container and that has a thrust supported face extending in a radial direction of the shaft, one of both ends of the shaft in an axial direction of the shaft being disposed in the high pressure side space, the other end of the shaft being disposed in the low pressure side space;

a first bearing that is positioned closer to the high pressure side space than the other end of the shaft and that supports the shaft in the radial direction;

a second bearing that is positioned closer to the low pressure side space than the first bearing and that supports the shaft in the radial direction;

a pump mechanism that is disposed between the first bearing and the second bearing in the axial direction of the shaft and that pumps a liquid by rotation of the shaft; and a thrust bearing that is disposed between the first bearing and the second bearing and that faces the thrust supported face of the shaft and that supports the shaft in the axial direction of the shaft.

The above-described liquid pump has high reliability.

DETAILED DESCRIPTION

Figure 1:
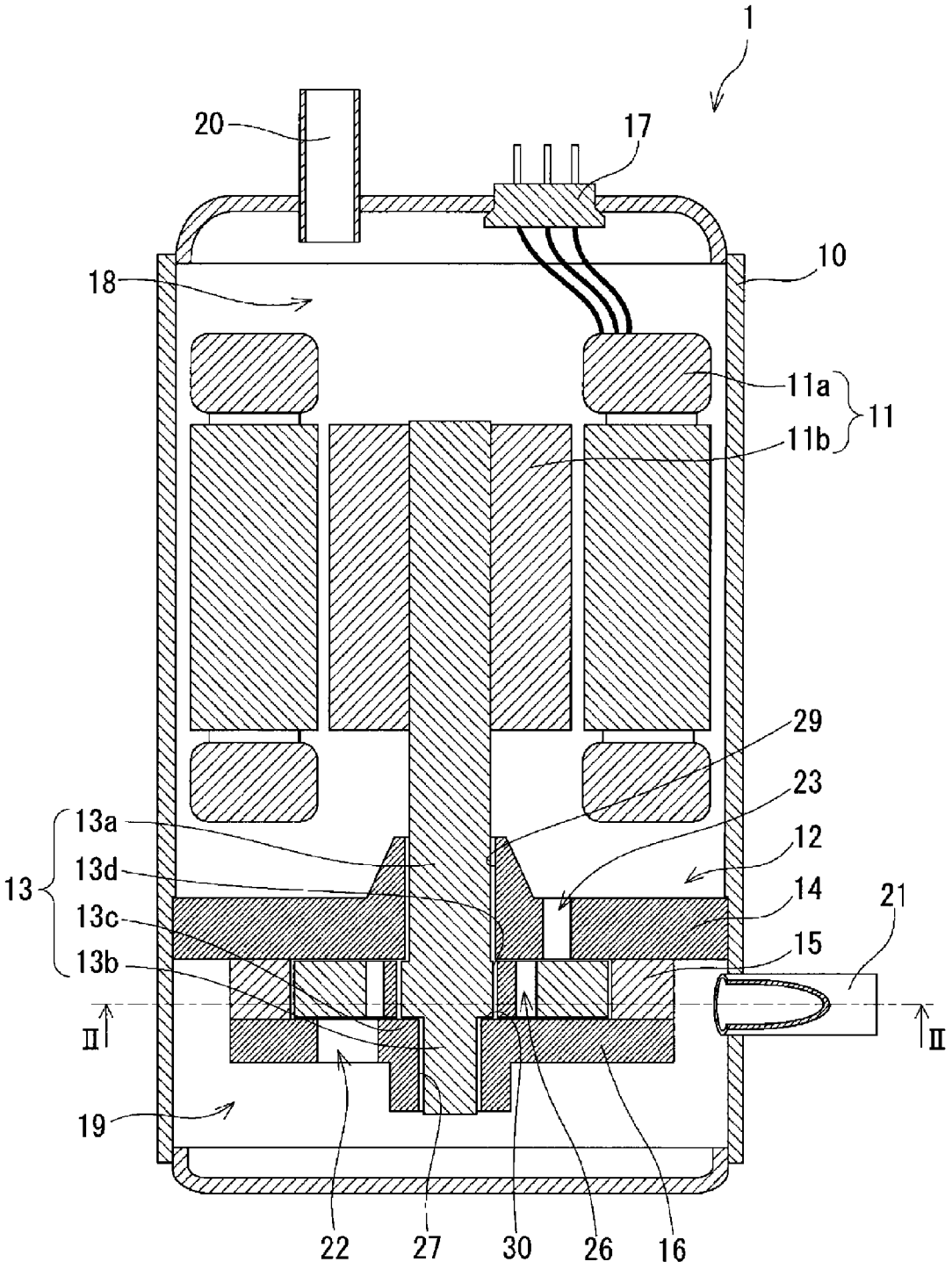
FIG. 1 is a longitudinal sectional view illustrating a liquid pump according to an embodiment of the present disclosure.

In the technique described in Japanese Unexamined Patent Application Publication No. 3-179187 it is not assumed that thrust (thrust force) in the axial direction is generated in the drive shaft 313, and the cooling medium pump 300 is not provided with a thrust bearing that supports the load of the drive shaft 313 in the axial direction. The magnet 305 is stuck to the outermost circumferential portion of the rotor 311*b*. When power is supplied to the brushless direct current electric motor 311, the rotor 311*b* rotates at a specific position where the magnetic center of the rotor 311*b* and the magnetic center of the stator 311*a* are aligned with each other in the axial direction of the drive shaft 313. When the rotor 311*b* is positioned in advance in the axial direction of the drive shaft 313 so that the magnetic center of the rotor 311*b* and the magnetic center of the stator 311*a* are aligned with each other, thrust in the axial direction is hardly generated when the rotor 311*b* rotates. Probably because of this situation, the cooling medium pump 300 is not provided with a thrust bearing that supports the load of the drive shaft 318 in the axial direction.

For instance, in a liquid pump used in a rankine cycle system, the difference between the discharge pressure and the suction pressure of the liquid pump may increase. In this case, thrust may be generated in the axial direction of the shaft used for the liquid pump due to the difference between the discharge pressure and the suction pressure of the liquid pump. In such a case, when the cooling medium pump 300 is used as a liquid pump, friction occurs between parts as thrust is generated in the axial direction of the drive shaft 313, and the parts may be damaged. In this manner, abnormal wear may occur in the parts and the reliability of the liquid pump may be reduced. For instance, when the inner rotor 325 is fixed to the drive shaft 313, the inner rotor 325 is pressed against the front plate 316 by thrust applied to the drive shaft 313, and the inner rotor 325 is worn out. Consequently, the product life of the cooling medium pump 300 may be shortened and the pump efficiency may reduce, and the reliability may decrease.

The first aspect of the present disclosure provides a liquid pump including:

a pressure container, an internal space of the pressure container being partitioned into a high pressure side space and a low pressure side space;

a shaft that is disposed in the pressure container and that has a thrust supported face extending in a radial direction of the shaft, one of both ends of the shaft in an axial direction of the shaft being disposed in the high pressure side space, the other end of the shaft being disposed in the low pressure side space;

a first bearing that is positioned closer to the high pressure side space than the other end of the shaft and that supports the shaft in the radial direction;

a second bearing that is positioned closer to the low pressure side space than the first bearing and that supports the shaft in the radial direction;

a pump mechanism that is disposed between the first bearing and the second bearing in the axial direction of the shaft and that pumps a liquid by rotation of the shaft; and a thrust bearing that is disposed between the first bearing and the second bearing and that faces the thrust supported face of the shaft and that supports the shaft in the axial direction of the shaft.

According to the first aspect, the load of the shaft in the axial direction can be received by the thrust bearing. Thus, even when the difference between the pressure in the high pressure side space and the pressure in the low pressure side space increases and the load of the shaft in the axial direction is increased, the shaft can be stably supported. Thus, the liquid pump has high reliability. In addition, since the thrust bearing is disposed to face the thrust supported face between the first bearing and the second bearing in the axial direction of the shaft, a reaction force to the load of the shaft in the axial direction is relatively large. Thus, the thrust bearing has a high load capacity. Thus, the product life of the liquid pump can be prolonged and decrease in the pump efficiency can be reduced. Consequently, the liquid pump has high reliability.

In addition to the first aspect, a second aspect of the present disclosure provides a liquid pump in which a fine passage for liquid is formed in an outer circumference of the shaft, the fine passage extending from the high pressure side space to the low pressure side space through the first bearing, the thrust bearing, and the second bearing in an order of the first bearing, the thrust bearing, and the second bearing. According to the second aspect, fluid is stably supplied from the high pressure side space to the thrust bearing through the fine passage, thereby stabilizing the pressure of the fluid in the thrust bearing. Thus, heat generation in the thrust bearing and occurrence of cavitation due to local variation in pressure can be reduced. Thus, even when the pressure of the high pressure side space or the low pressure side space varies due to a transient operation of the liquid pump in addition to when the liquid pump is in normal operation, the product life of the liquid pump can be prolonged and decrease in the pump efficiency can be reduced. Consequently, the liquid pump has high reliability.

In addition to the first and second aspects, a third aspect of the present disclosure provides a liquid pump in which the pump mechanism is fixed to the shaft in a rotation direction of the shaft, and is mounted on the shaft to be movable relative to the shaft in the axial direction of the shaft. According to the third aspect, even when a pressure variation or vibration in the axial direction of the shaft occurs in the pump mechanism due to a variation in the pressure of the high pressure side space or the low pressure side space or a variation in the rotational speed of the pump, the shaft is not affected and the magnitude of the load applied to the thrust bearing hardly changes. This is because the shaft is movable in the axial direction of the shaft relative to the rotating member of the pump mechanism. Thus, the product life of the liquid pump can be prolonged and decrease in the pump efficiency can be reduced. Consequently, the liquid pump has high reliability.

In addition to any one of the first to third aspects, a fourth aspect of the present disclosure provides a liquid pump in which a diameter of a portion of the shaft supported by the second bearing is smaller than a diameter of a portion of the shaft supported by the first bearing, and an internal diameter of the second bearing is smaller than an internal diameter of the first bearing. According to the fourth aspect, since the diameter of the portion of the shaft supported by the second bearing is smaller than the diameter of the portion of the shaft supported by the first bearing, the thrust supported face of the shaft is likely to have a larger area. Thus, the load capacity of the thrust bearing can be increased, and so when the difference between the pressure in the high pressure side space and the pressure in the low pressure side space increases, the product life of the liquid pump can be prolonged and decrease in the pump efficiency can be reduced. Consequently, the liquid pump has high reliability.

A fifth aspect of the present disclosure provides a rankine cycle system including: the liquid pump according to any one of the first to fourth aspects; a heater that heats a working fluid; an expander that expands the working fluid heated by the heater; and a heat radiator that radiates heat of the working fluid expanded by the expander. The liquid pump sucks the working fluid in a state of liquid through the heat radiator as the liquid by the pump mechanism, and pumps the liquid to the heater.

In order to increase the efficiency of a rankine cycle, it is preferable in the rankine cycle that the difference between the high pressure and the low pressure of the cycle be increased. In this case, the difference between the pressure in the high pressure side space and the pressure in the low pressure side space is increased in the liquid pump, and the load of the shaft in the axial direction is increased. According to the fifth aspect, even when the liquid pump is operated in such conditions, damage to parts can be prevented because the load capacity of the thrust bearing is large. Thus, even when a rankine cycle system is operated with high efficiency, the product life of the liquid pump can be prolonged and decrease in the pump efficiency can be reduced. Consequently, the liquid pump, and eventually the rankine cycle system have high reliability.

Hereinafter, an embodiment of the present disclosure will be described with reference to the drawings. It is to be noted that the following description relates to an example of the present disclosure, and the present disclosure is not limited to this.

Liquid Pump

As illustrated in FIG. 1, a liquid pump 1 includes a pressure container 10, a shaft 13, a first bearing 29, a second bearing 27, a pump mechanism 12, and a thrust bearing 30. The internal space of the pressure container 10 is partitioned into a high pressure side space 18 and a low pressure side space 19. The shaft 13 is disposed in the internal space of the pressure container 10, and has a thrust supported face 13*c* that extends in a radial direction of the shaft 13. One of both ends of the shaft 13 in the axial direction is disposed in the high pressure side space 18, and the other of both ends of the shaft 13 in the axial direction is disposed in the low pressure side space 19. The shaft 13 extends in the direction of gravity, for instance. The first bearing 29 is disposed closer to the high pressure side space 18 than the other of both ends of the shaft 13, disposed in the low pressure side space 19, and supports the shaft 13 in the radial direction of the shaft. The second bearing 27 is disposed closer to the low pressure side space 19 than the first bearing 29, and supports the shaft 13 in the radial direction of the shaft. The pump mechanism 12 is disposed between the first bearing 29 and the second bearing 27 in the radial direction of the shaft 13, and pumps the fluid by rotation of the shaft 13. In other words, the first bearing 29 is disposed closer to the high pressure side space 18 than the pump mechanism 12, and the second bearing 27 is disposed closer to the low pressure side space 19 than the pump mechanism 12. The thrust bearing 30 is disposed to face the thrust supported face 13*c* between the first bearing 29 and the second bearing 27 in the axial direction of the shaft 13, and supports the load of the shaft 13 in the axial direction. Each of the first bearing 29, the second bearing 27, and the thrust bearing 30 is a slide bearing in which a film of lubricant is formed, for instance, between the bearing surface of the bearing and the supported side of the shaft.

Figure 3:
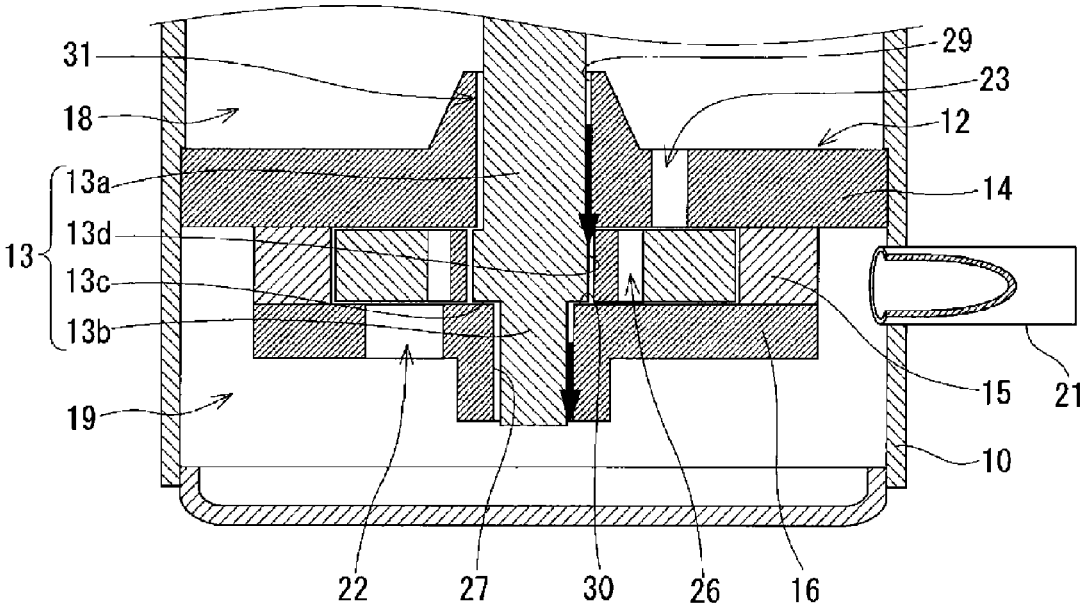
FIG. 3 is an enlarged sectional view of the principal portion of the liquid pump illustrated in FIG. 1.

As illustrated in FIG. 3, a fine passage 31 for liquid is formed, for instance, in the outer circumference of the shaft 13. The fine passage 31 extends from the high pressure side space 18 to the low pressure side space 19 through the first bearing 29, the thrust bearing 30, and the second bearing 27 in the order of the first bearing 29, the thrust bearing 30, and the second bearing 27. For instance, at least part of the fine passage 31 is formed by fine space between the outer circumference of the shaft 13, and the first bearing 29, the thrust bearing 30, the second bearing 27. Cylindrical fine space is formed, for instance, between the outer circumferential surface of the shaft 13 and the first bearing 29 or the second bearing 27. In this case, a minimum magnitude of the fine space in the radial direction of the shaft 13 is, for instance, 5 to 15 μm. For instance, part of the fine passage 31, formed by the first bearing 29 and the outer circumferential surface of the shaft 13 is in contact with the high pressure side space 18. In addition, part of the fine passage 31, formed by the second bearing 27 and the outer circumferential surface of the shaft 13 is in contact with the low pressure side space 19.

For instance, the diameter of the portion of the shaft 13 supported by the second bearing 27 is smaller than the diameter of the portion of the shaft 13 supported by the first bearing 29, and the internal diameter of the second bearing 27 is smaller than the internal diameter of the first bearing 29. For instance, as illustrated in FIG. 1, the shaft 13 has a major diameter portion 13*a* and a minor diameter portion 13*b*. The major diameter portion 13*a* has a relatively large diameter, and at least part of the major diameter portion 13*a* is supported by the first bearing 29. The minor diameter portion 13*b* has a relatively small diameter, and at least part of the minor diameter portion 13*b* is supported by the second bearing 27. The thrust supported face 13*c* is formed, for instance, between the major diameter portion 13*a* and the minor diameter portion 13*b* in the axial direction of the shaft 13.

As illustrated in FIG. 1, the liquid pump 1 further includes, for instance, an electric motor 11, a terminal 17, a suction pipe 21, and a discharge pipe 20. The liquid pump 1 is, for instance, an airtight pump. The pressure container 10 is an airtight container that has resistance to pressure, and the internal space of the pressure container 10 communicates with the outside of the pressure container 10 via only the suction pipe 21 or the discharge pipe 20. In the inside of the pressure container 10, the electric motor 11 is disposed at one end of the shaft 13 in the axial direction and the pump mechanism 12 is disposed at the other end of the shaft 13 in the axial direction.

The electric motor 11 includes a stator 11*a* and a rotor 11*b*. The electric motor 11 and the pump mechanism 12 are connected by the shaft 13 so as to operate the pump mechanism 12. The stator 11*a* is fixed to the inner circumferential surface of the pressure container 10, and the rotor 11*b* is fixed to the shaft 13. The terminal 17 is mounted on an upper portion of the pressure container 10. The terminal 17 is electrically connected to the electric motor 11, and power is supplied to the electric motor 11 by connecting the terminal 17 to a power supply. When power is supplied to the electric motor 11, the shaft 13 along with the rotor 11*b* rotates and the pump mechanism 12 operates.

The suction pipe 21 and the discharge pipe 20 are each mounted on the pressure container 10 so as to penetrate through the wall of the pressure container 10. The liquid to be sucked by the pump mechanism 12 is supplied to the inside of the pressure container 10 through the suction pipe 21. The liquid to be discharged from the pump mechanism 12 and to be exhausted to the outside of the pressure container 10 is exhausted to the outside of the pressure container 10 through the discharge pipe 20.

As illustrated in FIG. 1, the liquid pump 1 includes, for instance, an upper bearing member 14 and a lower bearing member 16. The upper bearing member 14 and the lower bearing member 16 are each a plate-like member and rotatably supports the shaft 13. A through hole is formed in the central portion of the upper bearing member 14 and the shaft 13 penetrates through the central portion of the upper bearing member 14. The bearing surface of the first bearing 29 is formed by the surface that defines the through hole formed in the central portion of the upper bearing member 14. A through hole is formed in the central portion of the lower bearing member 16 and the shaft 13 penetrates through the central portion of the lower bearing member 16. The bearing surface of the second bearing 27 is formed by the surface that defines the through hole formed in the central portion of the lower bearing member 16. Part of the upper surface of the central portion of the lower bearing member 16 faces the thrust supported face 13*c* of the shaft 13, and the bearing surface of the thrust bearing 30 is formed by the portion. The lower bearing member 16 has a suction hole 22 and the upper bearing member 14 has a discharge hole 23. The suction hole 22 is a through hole that is, for instance, on the radially outer side of the through hole in the central portion of the lower bearing member 16 and that penetrates through the lower bearing member 16 in a thickness direction. The discharge hole 23 is a through hole that is, for instance, on the radially outer side of the through hole in the central portion of the upper bearing member 14 and that penetrates through the upper bearing member 14 in a thickness direction.

The circumferential edge of the upper bearing member 14 is welded to the inner circumferential surface of the pressure container 10. Thus, the pump mechanism 12 is fixed to the pressure container 10. The internal space of the pressure container 10 is partitioned into the high pressure side space 18 and the low pressure side space 19 by the upper bearing member 14. The suction pipe 21 is mounted on the pressure container 10 at a position closer to the suction hole 22 than the upper bearing member 14 in the axial direction of the shaft 13. The discharge pipe 20 is mounted on the pressure container 10 upwardly of the upper bearing member 14. It is to be noted that the pump mechanism 12 may be fixed to the pressure container 10 by welding the circumferential edge of the lower bearing member 16 or the circumferential edge of a pump case 15 to the inner circumferential surface of the pressure container 10. In this case, the internal space of the pressure container 10 is partitioned into the high pressure side space 18 and the low pressure side space 19 by the lower bearing member 16 or the pump case 15.

Figure 2:
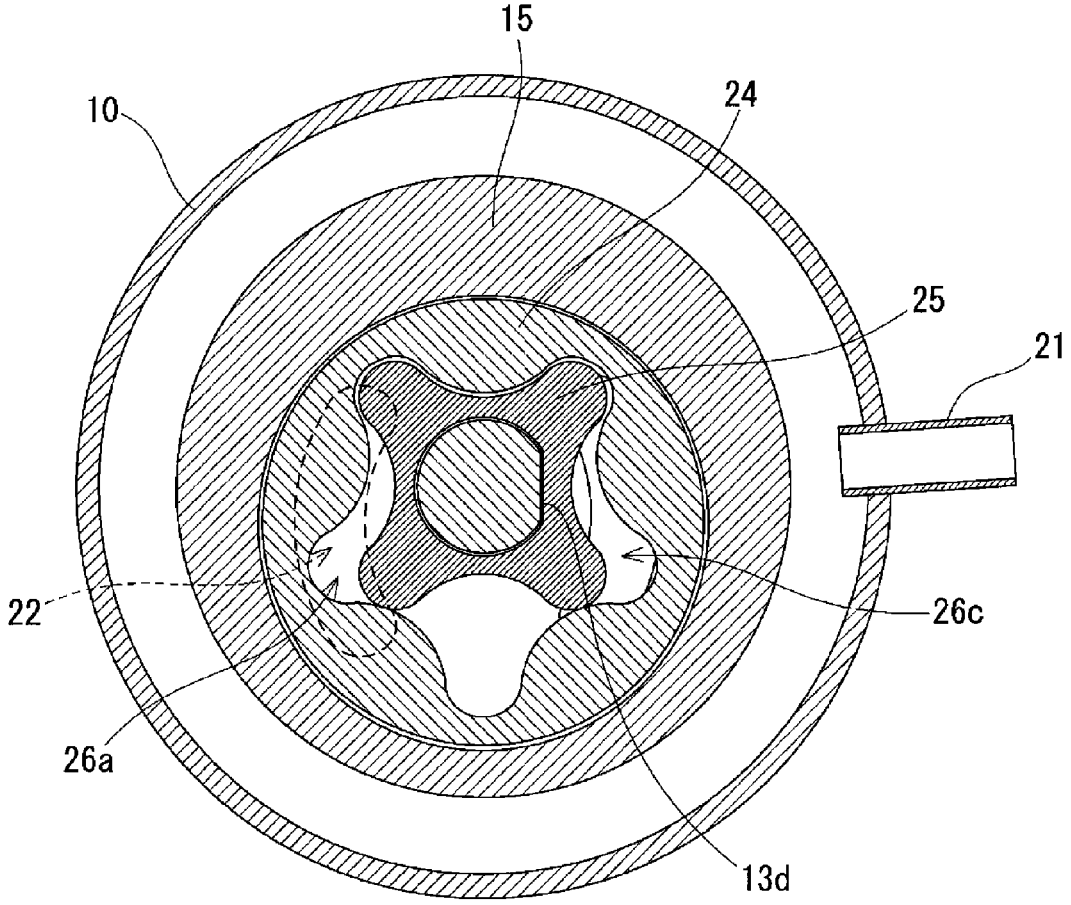
FIG. 2 is a transverse sectional view taken along line II-II of FIG. 1.

As illustrated in FIG. 2, the pump mechanism 12 includes a rotating member 25. The rotating member 25 is fixed to the shaft 13 in the rotation direction of the shaft 13, and is mounted on the shaft 13 so as to be movable relative to the shaft 13 in the axial direction of the shaft 13. The pump mechanism 12 is an inscribed gear pump, for instance. The pump mechanism 12 includes, for instance, the pump case 15, an outer gear 24, and an inner gear 25. In this case, the inner gear 25 corresponds to the rotating member 25. The outer gear 24 and the inner gear 25 are disposed inwardly of the pump case 15. The outer gear 24 is disposed outwardly of the inner gear 25 so as to surround the inner gear 25. Each of the pump case 15, the outer gear 24, and the inner gear 25 is disposed so as to be interposed between the upper bearing member 14 and the lower bearing member 16. The inner gear 25 is mounted on the shaft 13. As illustrated in FIG. 1 and FIG. 2, the shaft 13 has a flat portion 13*d*. In the portion of the shaft 13, on which the inner gear 25 is mounted, the flat portion 13*d* forms an outer circumferential surface which is flat and parallel to the axis of the shaft 13. The central portion of the inner gear 25 has a through hole which is formed by the inner circumferential surface having a shape fitted to the shape of the portion of the shaft 13, on which the inner gear 25 is mounted. The through hole is formed to have a slightly larger dimension than that of the outline of the portion of the shaft 13, on which the inner gear 25 is mounted. Thus, the inner gear 25 is fixed to the shaft 13 in the rotation direction of the shaft 13, and is mounted on the shaft 13 so as to be movable relative to the shaft 13 in the axial direction of the shaft 13. Consequently, when the shaft 13 rotates, the inner gear 25 rotates along with the shaft 13.

As illustrated in FIG. 2, the teeth of the outer gear 24 and the teeth of the inner gear 25 are formed to be engaged with each other. The rotational axis of the inner gear 25 is aligned with the rotational axis of the shaft 13. On the other hand, the outer gear 24 is disposed so that the rotational axis of the outer gear 24 has an offset from the rotational axis of the shaft 13. When the inner gear 25 rotates along with the shaft 13, the outer gear 24 is pressed by the teeth of the inner gear 25 and rotates along with the inner gear 25.

As illustrated in FIG. 1, a working chamber 26 of the pump mechanism 12 is formed by the outer circumferential surface of the inner gear 25, the inner circumferential surface of the outer gear 24, the lower surface of the upper bearing member 14, and the upper surface of the lower bearing member 16. The outer gear 24 and the inner gear 25 rotate as the shaft 13 rotates, thereby the pump mechanism 12 operates while repeating a suction process and a discharge process. In other words, the rotation of the outer gear 24 and the inner gear 25 causes the working chamber 26 to shift from a state of a suction chamber 26*a* to a state of a discharge chamber 26*c* or from a state of the discharge chamber 26*c* to a state of the suction chamber 26*a*. Here, the suction chamber 26*a* is a portion of the working chamber 26 which is in communication with the suction hole 22, and the discharge chamber 26*c* is a portion of the working chamber 26 which is in communication with the discharge hole 23. In a suction process, the volume of the suction chamber 26*a* increases as the shaft 13 rotates, and when the suction chamber 26*a* and the suction hole 22 cease to communicate with each other, the suction process is completed. When the working chamber 26 after the completion of the suction process starts to communicate with the discharge hole 23 by further rotation of the shaft 13, shift to the discharge chamber 26*c* is made. The volume of the discharge chamber 26*c* decreases as the shaft 13 rotates. When the discharge chamber 26*c* and the discharge hole 23 cease to communicate with each other, the discharge process is completed. In this manner, due to the rotation of the shaft 13, the liquid is supplied to the pump mechanism 12 through the suction hole 22, and the liquid is discharged from the pump mechanism 12 through the discharge hole 23.

In the liquid pump 1, the fluid is sucked into the inside of the pressure container 10 through the suction pipe 21. The liquid sucked in the pressure container 10 is temporarily stored in the low pressure side space 19, and is supplied to the pump mechanism 12 through the suction hole 22. The liquid supplied to the pump mechanism 12 is pumped and discharged to the high pressure side space 18 formed inside the pressure container 10 through the discharge hole 23, then is discharged to the outside of the pressure container 10 through the discharge pipe 20. The low pressure side space 19 stores low pressure liquid before pumping by the pump mechanism 12, and the high pressure side space 18 stores high pressure liquid which has been pumped by the pump mechanism 12. For this reason, high pressure is applied to the end of the shaft 13, closer to the high pressure side space 18, and low pressure is applied to the end of the shaft 13, closer to the low pressure side space 19. Thus, a load (thrust force) is generated in the shaft 13 in the axial direction from the high pressure side space 18 to the low pressure side space 19. In the case where the shaft 13 extends in the direction of gravity, a load is generated in the axial direction from the high pressure side space 18 to the low pressure side space 19 also by the self-weight of the shaft 13 and the rotor 11*b*. The thrust bearing 30 can receive such a load. Consequently, even when the difference between the pressure of the fluid in the high pressure side space 18 and the pressure of the fluid in the low pressure side space 19 is large, it is possible to prevent damage due to friction between the parts caused by the load in the axial direction of the shaft 13. Since the thrust bearing 30 can properly support the load in the axial direction of the shaft 13, the product life of the liquid pump 1 can be prolonged and decrease in the pump efficiency can be reduced. Thus, the liquid pump 1 has high reliability.

A relatively high pressure is applied to the end of the fine passage 31 closer to the high pressure side space 18 by the high pressure liquid stored in the high pressure side space 18. On the other hand, a relatively low pressure is applied to the end of the fine passage 31 closer to the low pressure side space 19 by the low pressure liquid stored in the low pressure side space 19. Thus, as illustrated in FIG. 3, a predetermined quantity of liquid flows from the high pressure side space 18 to the low pressure side space 19 through the fine passage 31. The arrow in the fine passage 31 of FIG. 3 indicates the direction of the flow of the liquid. Thus, a predetermined quantity of liquid is always guided to the thrust bearing 30, and the pressure in the thrust bearing 30 is thereby stabilized. Since the pressure in the thrust bearing 30 is stabilized, heat generation in the thrust bearing and occurrence of cavitation due to local variation in the pressure of the liquid can be reduced. Thus, even when the pressure of the high pressure side space 18 or the low pressure side space 19 varies due to a transient operation of the liquid pump 1 in addition to when the liquid pump 1 is in normal operation, the product life of the liquid pump 1 can be prolonged and decrease in the pump efficiency can be reduced. Thus, the liquid pump 1 has high reliability.

The first bearing 29, the thrust bearing 30, and the second bearing 27 can be lubricated and cooled by the liquid that flows through the fine passage 31. In addition, it is possible to easily discharge foreign matter present inside the first bearing 29, the thrust bearing 30, or the second bearing 27 by the flow of the liquid in the fine passage 31. Consequently, damage to the bearing can be prevented. Thus, the product life of the liquid pump can be prolonged and decrease in the pump efficiency can be reduced. Thus, the liquid pump 1 has high reliability.

The first bearing 29 and the second bearing 27 support the shaft 13 at different positions in the axial direction of the shaft 13. The first bearing 29 is located in the vicinity of the high pressure side space 18, and the second bearing 27 is located in the vicinity of the low pressure side space 19. The thrust bearing 30 is disposed between the first bearing 29 and the second bearing 27 in the axial direction of the shaft 13. The portion of the fine passage 31, formed by the first bearing 29 and the outer circumferential surface of the shaft 13 is in contact with the high pressure side space 18. For this reason, the pressure inside the first bearing 29 is close to the pressure in the high pressure side space 18. The portion formed by the second bearing 27 and the outer circumferential surface of the shaft 13 is in contact with the low pressure side space 19. For this reason, the pressure inside the second bearing 27 is close to the pressure in the low pressure side space 19. The internal space of the first bearing 29 communicates with the internal space of the second bearing 27 without being sealed to each other. For this reason, the pressure in the vicinity of the thrust bearing 27 is an intermediate pressure between the pressure inside the first bearing 29 and the pressure inside the second bearing 27. Thus, the intermediate pressure is applied to the thrust supported face 13*c* of the shaft 13, and therefore, the load of the shaft 13 in the axial direction applied from the high pressure side space 18 to the low pressure side space 19 can be reduced. Consequently, the load applied to the thrust bearing 30 is reduced. Thus, the product life of the liquid pump 1 can be prolonged and decrease in the pump efficiency can be reduced. Thus, the liquid pump 1 has high reliability.

In the case where the pressure of the high pressure side space 18 or the pressure of the low pressure side space 19 varies, or the rotational speed of the pump varies, a pressure variation or vibration may occur in the inner gear 25 in the axial direction of the shaft 13. Even in such a case, since the inner gear 25 is movable relative to the shaft 13 in the axial direction of the shaft 13, the pump mechanism 12 is hardly affected. Thus, the load received by the thrust bearing 30 hardly varies. Consequently, the product life of the liquid pump 1 can be prolonged and decrease in the pump efficiency can be reduced. Thus, the liquid pump 1 has high reliability.

As described above, the diameter of the portion of the shaft 13 supported by the second bearing 27 is smaller than the diameter of the portion of the shaft 13 supported by the first bearing 29, and the internal diameter of the second bearing 27 is smaller than the internal diameter of the first bearing 29. Thus, since the thrust supported face 13*c* can be increased, the load capacity of the thrust bearing 30 is increased. Due to the increased area of the thrust supported face 13*c*, a reaction force to the load applied to the shaft 13 in the axial direction is increased by the pressure of the high pressure side space 18. Thus, the load of the shaft 13 applied in the axial direction can be reduced, and the load applied to the thrust bearing 30 can be reduced. Thus, in particular, even when the difference between the pressure of the fluid in the high pressure side space 18 and the pressure of the fluid in the low pressure side space 19 is large, the product life of the liquid pump 1 can be prolonged and decrease in the pump efficiency can be reduced. Consequently, the liquid pump 1 has high reliability.

The pump mechanism 12 may be a gear pump other than an inscribed gear pump, a positive displacement pump such as a vane pump and a rotary pump, a dynamic pump such as a centrifugal pump, a mixed flow pump, and an axial flow pump, or a screw pump.

A groove extending in the axial direction of the shaft 13 may be formed in the outer circumferential surface of the shaft 13, in the surface that defines the through hole formed in the central portion of the upper bearing member 14, or in the surface that defines the through hole formed in the central portion of the lower bearing member 16. In this case, at least part of the fine passage 31 is formed by one such groove.

Rankine Cycle System

Figure 4:
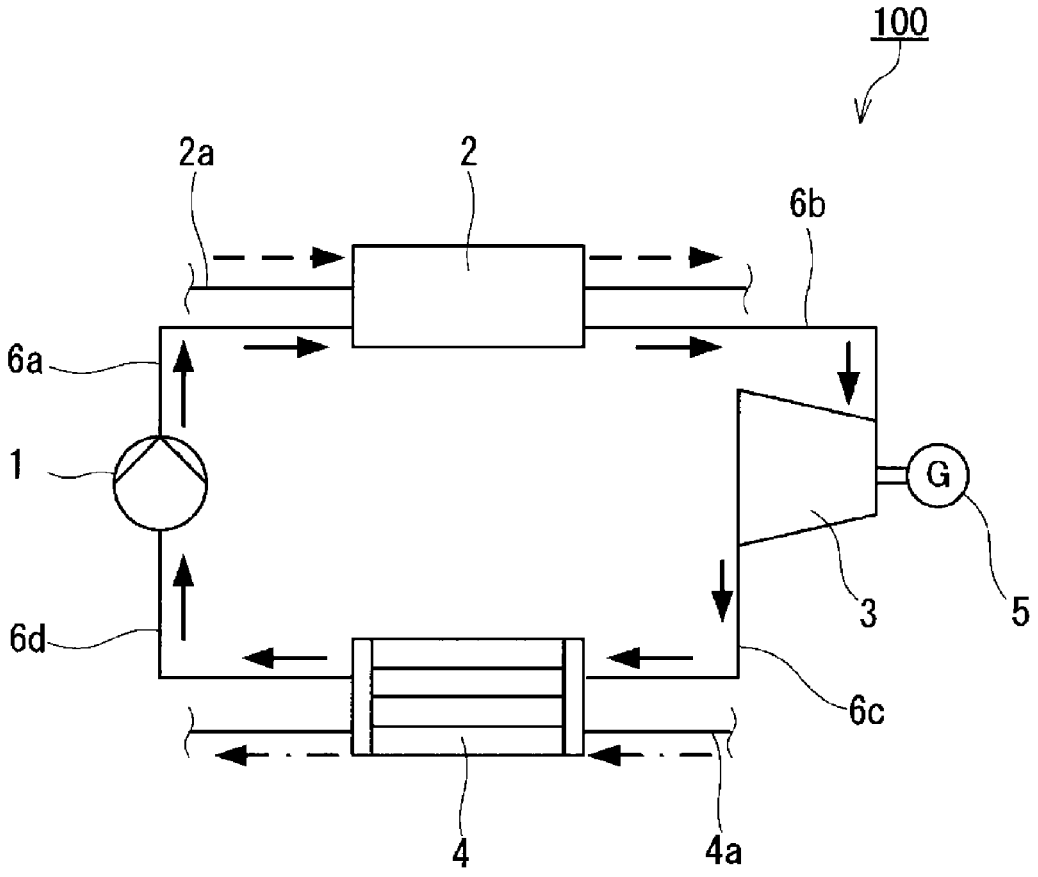
FIG. 4 is a configuration diagram of a rankine cycle system according to the embodiment of the present disclosure.
Figure 5:
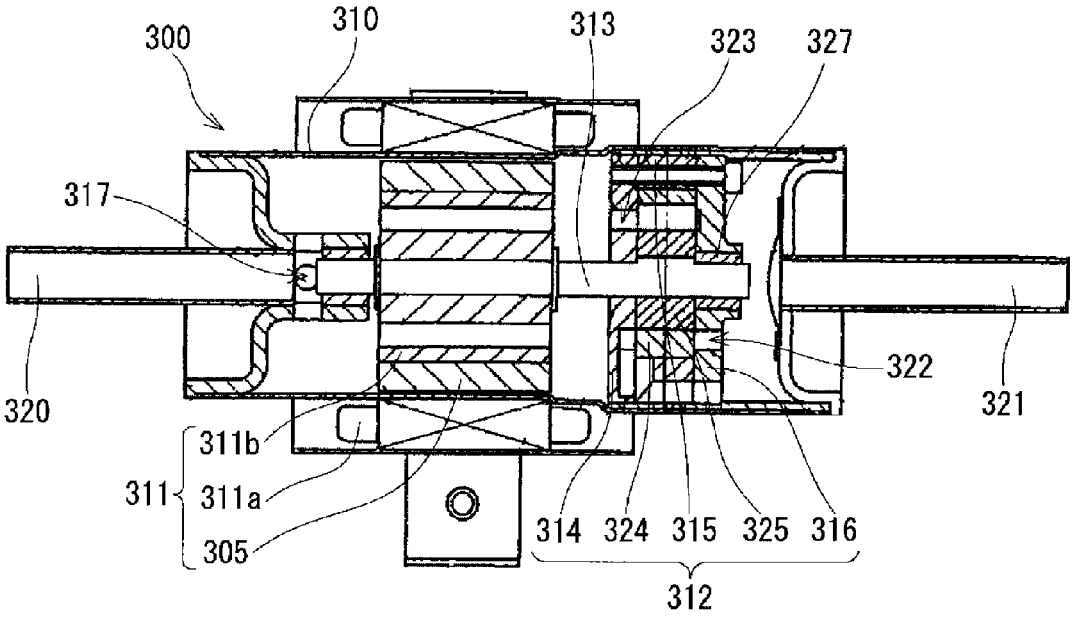
FIG. 5 is a sectional view illustrating a conventional liquid pump.

Next, a rankine cycle system 100 including the liquid pump 1 will be described. As illustrated in FIG. 4, the rankine cycle system 100 includes the liquid pump 1, a heater 2, an expander 3, and a heat radiator 4. The rankine cycle system 100 includes a passage 6*a*, a passage 6*b*, a passage 6*c*, and a passage 6*d*. The liquid pump 1, the heater 2, the expander 3, and the heat radiator 4 are annularly connected in that order by the passage 6*a*, the passage 6*b*, the passage 6*c*, and the passage 6*d*. The passage 6*a* connects the outlet of the liquid pump 1 and the inlet of the heater 2. The discharge pipe 20 forms at least part of the passage 6*a*. The passage 6*b* connects the outlet of the heater 2 and the inlet of the expander 3. The passage 6*c* connects the outlet of the expander 3 and the inlet of the heat radiator 4. The passage 6*d* connects the outlet of the heat radiator 4 and the inlet of the liquid pump 1. The suction pipe 21 forms at least part of the passage 6*d*.

Although the working fluid of the rankine cycle system 100 is not particularly limited, an organic working fluid, for instance, may be preferably used. The organic working fluid is, for instance, an organic compound such as halogenated hydrocarbon, hydrocarbon, or alcohol. The halogenated hydrocarbon is, for instance, R-123, R365mfc, or R-245fa. The hydrocarbon is, for instance, alkane such as propane, butane, pentane, or isopentane. The alcohol is ethanol, for instance. These organic working fluids may be used alone or two or more types of the organic working fluids may be mixed and used. In addition, an inorganic working fluid such as water, carbon dioxide, and ammonium may be used as the working fluid.

The heater 2 heats the working fluid in a rankine cycle. The heater 2 absorbs thermal energy from a heat carrier such as warm water obtained from geothermal heat, a combustion gas or an exhaust gas of a boiler or a combustion oven, for instance, and heats and vaporizes the working fluid by the absorbed thermal energy. As illustrated in FIG. 4, the passage 2*a* for a heat carrier is connected to the heater 2. When the heat carrier is liquid such as warm water, a plate type heat exchanger or a double-tube type heat exchanger is preferably used as the heater 2. Also, when the heat carrier is a gas such as a combustion gas or an exhaust gas, a fin tube heat exchanger is preferably used as the heater 2. In FIG. 4, the solid line arrow indicates the direction of a flow of the working fluid, and the dashed line arrow indicates the direction of a flow of the heat carrier.

The expander 3 is a fluid machine for expanding the working fluid heated by the heater 2. The rankine cycle system 100 further includes a power generator 5. The power generator 5 is connected to the expander 3. The expander 3 obtains rotational power by expansion of the working fluid in the expander 3. The rotational power is converted into electricity by the power generator 5. The expander 3 is, for instance, a positive displacement or dynamic expander. The types of positive displacement expander include rotary type, screw type, reciprocating type, and scroll type. The types of dynamic expander include centrifugal type and axial flow type.

The heat radiator 4 radiates the heat of the working fluid which has expanded by the expander 3. Specifically, heat exchange between the working fluid and a cooling medium in the heat radiator 4 causes the working fluid to be cooled and the cooling medium to be heated. The passage 4*a* for the cooling medium is connected to the heat radiator 4. In FIG. 4, the dashed-dotted line arrow indicates the direction of a flow of the cooling medium. A publicly known heat exchanger such as a plate type heat exchanger, a double-tube type heat exchanger, and a fin tube heat exchanger may be used as the heat radiator 4. The type of the heat radiator 4 is properly selected according to the type of the cooling medium. When the cooling medium is fluid such as water, a plate type heat exchanger or a double-tube type heat exchanger is preferably used. Also, when the cooling medium is a gas such as air, a fin tube heat exchanger is preferably used.

The working fluid flowing out from the heat radiator 4 is in a state of liquid. In other words, the liquid state working fluid flowing out from the heat radiator 4 is guided to the inside of the pressure container 10 through the suction pipe 21. The liquid pump 1 sucks the liquid state working fluid through the heat radiator 4 as the aforementioned liquid by the pump mechanism 12, and pumps the liquid to the heater 2. The working fluid is pressurized by the liquid pump 1, and the pressurized working fluid is supplied to the heater 2 through the passage 6*d*. In order to increase the efficiency of a rankine cycle, it is preferable in the rankine cycle that the difference between the high pressure and the low pressure of the cycle be increased. In this case, the difference between the pressure of the high pressure side space 18 and the pressure of the low pressure side space 19 in the liquid pump 1 is increased, and the load of the shaft 13 in the axial direction toward the thrust bearing 30 is increased. Using the liquid pump 1, even when the liquid pump 1 is operated in such conditions, damage to the parts such as the thrust bearing 30 can be prevented because the load capacity of the thrust bearing 30 is large. Thus, even when the rankine cycle system 100 is operated with high efficiency, the product life of the liquid pump 1 can be prolonged and decrease in the pump efficiency can be reduced. Thus, the liquid pump 1 has high reliability.

REFERENCE SIGNS LIST

1: liquid pump
10: Pressure container
12: Pump mechanism
13: Shaft
13*c*: Thrust supported face
18: High pressure side space
19: Low pressure side space
25: Rotating member (inner gear)
27: Second bearing
29: First bearing
30: Thrust bearing
31: Fine passage
100: Rankine cycle system

What is claimed is:

1. A liquid pump comprising:

a pressure container, an internal space of the pressure container being partitioned into a high pressure side space and a low pressure side space;

a shaft that is disposed in the pressure container and that has a thrust supported face extending radially outward from an outer circumferential surface of the shaft, one of both ends of the shaft in an axial direction of the shaft being disposed in the high pressure side space, the other end of the shaft being disposed in the low pressure side space;

a first bearing that is positioned closer to the high pressure side space than the other end of the shaft and that supports the shaft in the radial direction;

a second bearing that is positioned closer to the low pressure side space than the first bearing and that supports the shaft in the radial direction; and a pump mechanism that is disposed between the first bearing and the second bearing in the axial direction of the shaft and that pumps a liquid by rotation of the shaft, wherein the second bearing includes a thrust bearing portion that is disposed between the first bearing and the second bearing in the axial direction of the shaft and that faces the thrust supported face of the shaft to support the shaft in the axial direction of the shaft, and wherein a fine passage for liquid is formed in an outer circumference of the shaft, the fine passage extending from the high pressure side space to the low pressure side space through the first bearing, the thrust bearing, and the second bearing in an order of the first bearing, the thrust bearing, and the second bearing.

2. The liquid pump according to claim 1, wherein the pump mechanism includes a rotating member that is fixed to the shaft in a rotation direction of the shaft, and that is mounted on the shaft to be movable relative to the shaft in the axial direction of the shaft.

3. The liquid pump according to claim 1, wherein a diameter of a portion of the shaft supported by the second bearing is smaller than a diameter of a portion of the shaft supported by the first bearing, and an internal diameter of the second bearing is smaller than an internal diameter of the first bearing.

4. A rankine cycle system comprising:

the liquid pump according to claim 1;

a heater that heats a working fluid;

an expander that expands the working fluid heated by the heater; and a heat radiator that radiates heat of the working fluid expanded by the expander, wherein the liquid pump sucks the working fluid in a state of liquid through the heat radiator as the liquid by the pump mechanism, and pumps the liquid to the heater.

* * * * *